US006166998A

United States Patent [19]

Hare et al.

[11] Patent Number: 6,166,998

[45] Date of Patent: Dec. 26, 2000

[54] MOULDED TRANSDUCER

[75] Inventors: Ronald Gregory Hare; John William Thomas, both of Peterborough, Canada

[73] Assignee: Milltronics Ltd., Peterborough, Canada

[21] Appl. No.: 09/178,699

[22] Filed: Oct. 26, 1998

[30] Foreign Application Priority Data

Oct. 24, 1997 [GB] United Kingdom ..... 9722466
May 1, 1998 [GB] United Kingdom ..... 9809435

[51] Int. Cl.[7] ..... H04R 17/00; H04R 31/00

[52] U.S. Cl. ..... 367/176; 367/162; 29/25.35; 29/594

[58] Field of Search ..... 367/157, 162, 367/165, 173, 176; 29/25.35, 594

[56] References Cited

U.S. PATENT DOCUMENTS 3,674,945 7/1972 Hands ..... 381/111
3,775,816 12/1973 Gordon et al. ..... 29/25.35
5,014,813 5/1991 Fussell ..... 367/178
5,339,292 8/1994 Brown et al. ..... 367/176

*Primary Examiner*—Ian J. Lobo
*Attorney, Agent, or Firm*—Ridout & Maybee

[57] ABSTRACT

An electro-acoustic transducer is manufactured by forming a transducer assembly at least one piezoelectric element, electrodes contacting the element, and acoustic loading blocks, and applying successive superposed mouldings of material of differing acoustic properties around said transducer assembly to form the transducer, while maintaining electrical coupling between the transducer assembly and the exterior of the transducer, the mouldings providing at least one acoustic matching layer covering a radiating surface of the transducer assembly, a casing surrounding the remainder of the transducer assembly, at least one layer of acoustic isolating material between the casing and the transducer assembly. The successive layers may either be moulded in situ, or moulded separately and then assembled.

6 Claims, 2 Drawing Sheets

MOULDED TRANSDUCER

FIELD OF THE INVENTION

This invention relates to electro-acoustic transducer used for example in acoustic pulse-echo ranging system.

BACKGROUND OF THE INVENTION

Such transducers are typically piezoelectric in operation, with one or more piezoelectric elements and associated contact electrodes clamped between loading blocks to provide a relatively high-Q assembly that will oscillate at a predetermined frequency when excited by an alternating electric potential at that frequency so as to transmit acoustic energy. The same transducer is commonly used to receive reflected acoustic energy at that frequency and convert it back to electrical energy.

Since the potentials required to excite such transducers are typically quite high, and they are high impedance devices, and may need to be located some distance from a transceiver which generates the excitation signal and processes received signals, they are usually associated with an impedance matching transformer and possibly also with temperature sensing components and preamplifying or preprocessing circuits for received signals. Furthermore, it is usually necessary to provide acoustic matching between the transducer assembly and a surrounding medium, usually gaseous, to provide the transducer assembly with suitable directional properties, to protect the transducer assembly from the surrounding medium, and to isolate the transducer assembly as far as possible from the structure on which it is mounted.

The above requirements must be accommodated by the enclosures applied to house such transducers. Typically, the transducer assembly is wrapped on its non-radiating surfaces with a material such as cork, and placed in a moulded or fabricated metallic or moulded plastic shell which may be selectively lined with material such as cork and is then filled with a potting compound so as to embed the transducer assembly. The shell may be open on a side corresponding to the radiating surface of the transducer, in which case a layer or layers of acoustic matching material may be cast into the shell so as to cover the radiating surface of the assembly, or it may be closed by a thin diaphragm at that surface, in which case matching material must be installed within the diaphragm prior to inserting and potting the transducer. In either case, the assembly process is slow, laborious, labour intensive, and must be carefully controlled so that components are properly located within the shell. The installation of transformers and other electronic components further complicates the process.

Typical transducers are described in U.S. Pat. Nos. 3,674,945 (Hands) and 5,339,292 (Brown et al).

SUMMARY OF THE INVENTION

It is an object of the present invention to provide an improved technique for packaging acoustic transducers which simplifies and improves control over the assembly process.

According to the invention, a method of manufacturing an electro-acoustic transducer comprises forming a transducer assembly comprising at least one piezoelectric element, electrodes contacting the element, and acoustic loading blocks, and applying successive superposed mouldings of material of differing acoustic properties around said transducer assembly to provide the transducer, while maintaining electrical coupling between the transducer assembly and the exterior of the transducer, the mouldings providing at least one acoustic matching layer covering a radiating surface of transducer assembly, a casing surrounding the remainder of the transducer assembly, and at least one layer of acoustic isolating material between the casing and the transducer assembly. The mouldings may either be moulded in situ, or premoulded, or some moulded in situ with at least the casing premoulded.

The invention is described further below with reference to the accompanying drawings.

SHORT DESCRIPTION OF THE DRAWINGS

FIG. 1 is a cross-section through a first embodiment of transducer manufactured in accordance with the invention, and FIG. 2 is a cross-section through a second embodiment of transducer manufactured in accordance with the invention.

DESCRIPTION OF THE PREFERRED EMBODIMENTS

Figure 1:
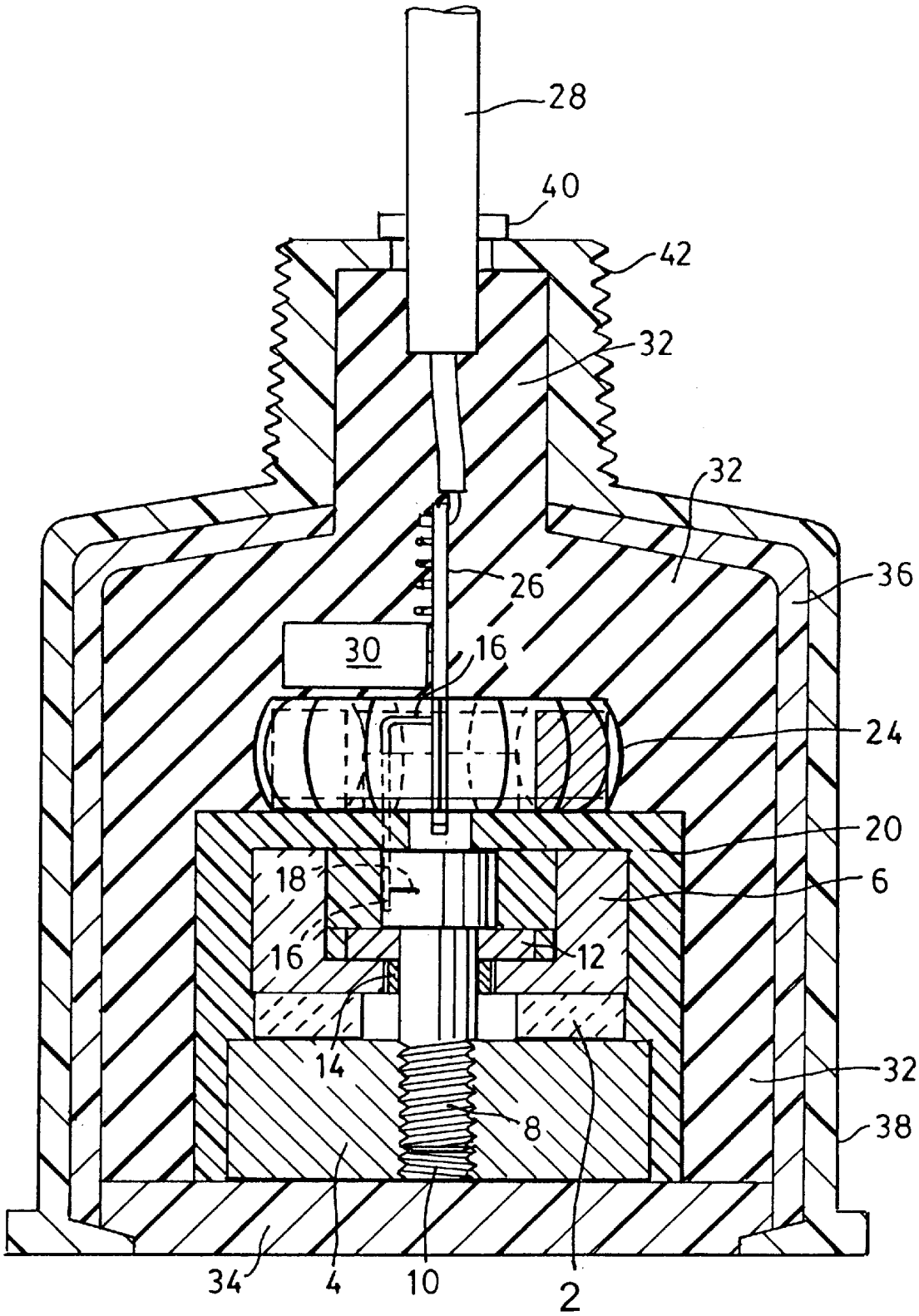

A first embodiment of the method of manufacture of a transducer in accordance with the invention will be described with reference to FIG. 1.

A first stage in manufacture is the assembly of a transducer assembly comprising a ceramic piezo-electric transducer element 2 secured between a steel driver block 4 and steel loading block 6 by a machine screw 8 engaging a threaded socket 10 in the block 4 and bearing on the block 6 through an electrically insulating washer assembly 12. The screw is further isolated from the block 6 by an insulating sleeve 14 surrounding the stem of the screw where it passes through the block 6. The element 2 and the masses of the blocks 4 and 6 are selected so that the assembly will have a desired resonant frequency typically in the low ultrasonic range.

In order to provide electrical connections to the assembly, rigid wires 16 and 18 are spot welded respectively to the block 6 and the head of the screw 8 so as to project upwardly from the top (as shown in the drawing) of the transducer assembly.

In the next stage, the assembly is placed in a mould and a damping layer of relatively soft polymer is moulded around the entire assembly except for the bottom surface of the block 4 which is the radiating surface of the transducer assembly. The layer to has an external configuration which is generally cylindrical except for a cylindrical axial boss 22 at its top end through which the wires 16 an 18 protrude. The layer 20 may be formed for example of flame retardant nitrile rubber of 25 durometer hardness.

Following this stage, a toroidal matching transformer 24 is located coaxially on the boss 22, and a small printed circuit board 26 is secured above the transformer by soldering the wires 16 and 18 to it. Connections from the primary and secondary of the transformer are also soldered to the board, to which the conductors of a lead-in cable 28 are also secured. The board also carries such components as a tuning capacitor 30, a temperature sensing thermistor and other small components associated with matching the transducer to the line through the transformer, as well as establishing connections between the various components to maintain electrical coupling between the transducer assembly and the outside of the transducer. The configuration of the transformer and associated components may be in accordance with known practice, for example as disclosed in U.S. Pat.

No. 5,347,485 (Cherek et al), and forms no part of the present invention beyond the necessity to accommodate components thereof in the transducer. This stage completes electrical assembly of the transducer.

In a following stage, further layers 32, 34 of harder rubber are moulded on to surround the entire assembly, except for the distal portion of cable 28. In the example shown, these layers are of 70 durometer hardness flame retardant nitrile rubber. The layer 34 covers the bottom face of the block 4 to form an acoustic matching layer as described further in the Hands and Brown et al patents referenced above. If the properties required in the matching layer 34 are different from those required in the layer 32, then they may be moulded separately from different materials. Such separately moulded layers are in any case preferred to facilitate positioning of the assembly in the mould. If the transducer is to be utilized in a particularly aggressive atmosphere, it is possible to cast in a very thin diaphragm (not shown) of stainless steel or other resistant material beneath the layer 34 to protect the radiating ace of the latter.

Next, a further damping layer 36, typically of the same material as the layer 20, is applied around the layer 32. According to the design of the transducer, the layer 36 may not be required in all cases.

Finally an external casing 38 in form of an outer generally cylindrical shell of rigid synthetic resin such as polypropylene or polyvinylidene fluoride is moulded over the entire assembly and around a strain relief portion 40 of the layer 32 around the cable 28. The casing 38 may be moulded with a mounting thread 42. Instead of the layer 38 being moulded in situ over the layer 36, it may be preformed in a separate operation, and the assembly with layer 36 applied pressed into it.

Particularly if the layers 32 and 34 are moulded separately, none of the layers of material moulded onto the transducer assembly completely envelopes the assembly produced by the preceding stage, thus facilitating rigid positioning of the assembly within each mould used defining a mould cavity into which the material of a layer is injected.

It will be noted that successive superposed layers of moulded material between the cylindrical wall of the casing 38 have in general alternating degrees of hardness, thus contributing to isolating the active components of transducer acoustically from its outer casing.

Rather than moulding most of the layers in situ, the layers may all be premoulded, as described below with reference to FIG. 2. This has been found to provide better dimensional control, since the pressures involved in moulding layers in situ can result in deformation of internal layers which when released may deform subsequently applied surperposed layers.

Figure 2:
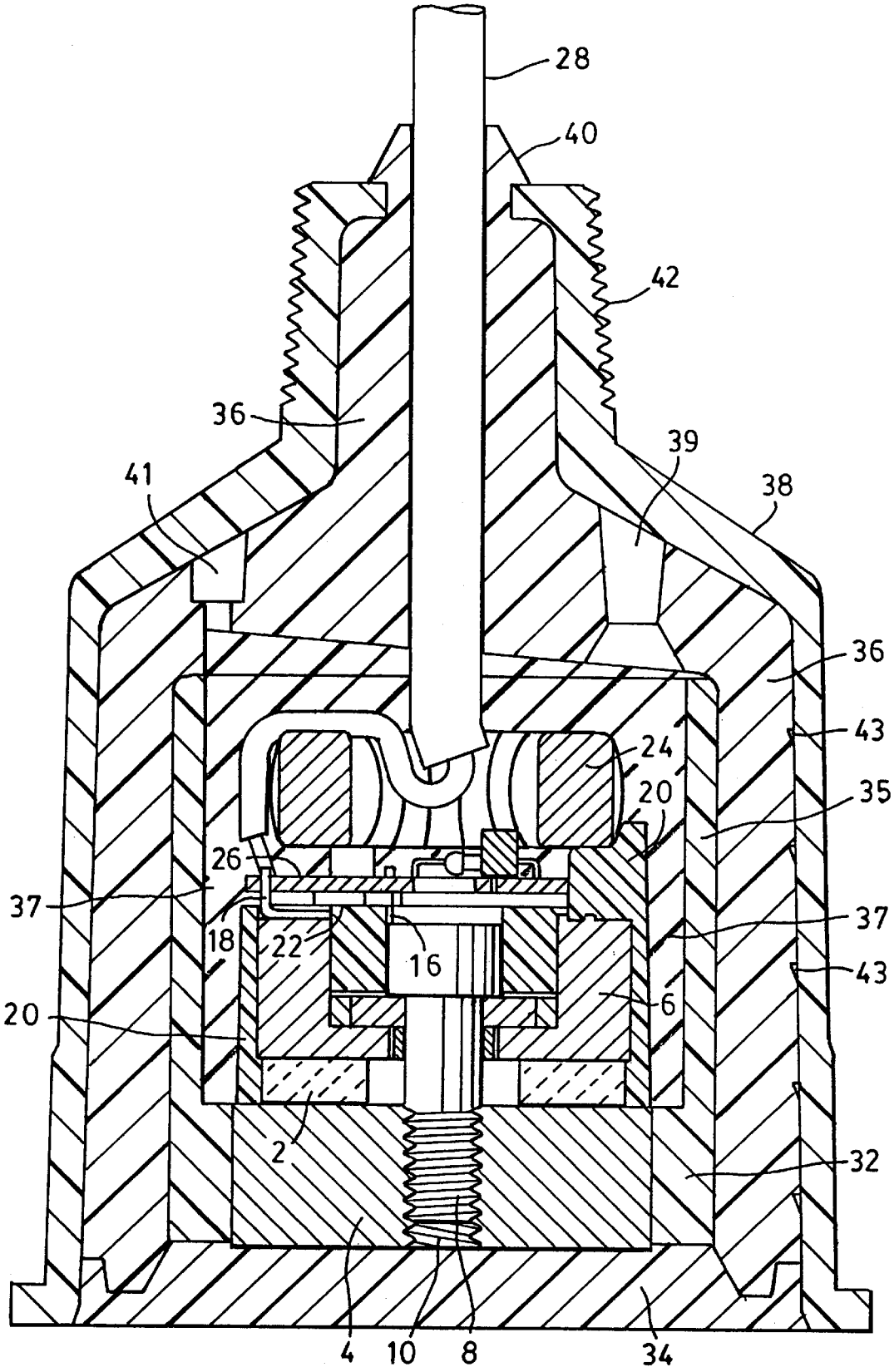

Referring to FIG. 2, in which similar reference numerals are utilized where possible, a first stage in manufacture is as before the assembly of a transducer assembly comprising a ceramic piezo-electric transducer element 2 secured between an aluminum driver block 4 and a steel loading block 6 by a machine screw 8 engaging a threaded socket 10 in the block 4 and bearing on the block 6 through an electrically insulating washer assembly it which includes an insulating sleeve 14 surrounding the stem of the screw where it passes through the block 6. The element 2 and the masses of the blocks 4 and 6 are selected so that the assembly will have a desired resonant frequency typically in the low ultrasonic range.

In order to provide electrical connection to the assembly, rigid wires 16 and 18 are spot welded respectively to the block 6 and the head of the screw 8 so as to project upwardly from the top (as shown in the drawing) of the transducer assembly.

In the next stage, the assembly is inserted into a moulding forming a damping layer 20 of relatively soft polymer. The moulding envelopes the upper portion of the assembly except for the side and bottom surfaces of the block 4, the bottom surface of which is the radiating surface of the transducer assembly. The layer 20 has an external configuration which is generally cylindrical except for a shelf 22 at its top end through which the wires 16 and 18 protrude. The moulding providing the layer 20 may be moulded for example from flame retardant nitrile rubber of 25 durometer hardness. The moulding is adhered to the side surfaces of the block 6 using a cyanocrylate adhesive applied to the surfaces prior to assembly.

Following this stage, a toroidal matching transformer 24 is located coaxially with the assembly above a small printed circuit board 26 secured on the shelf beneath the transformer by soldering the wires 16 and 18 to it. Connections from the primary and secondary of the transformer are also soldered to the board, to which the conductors of a lead-in cable 28 are also secured. The board also carries such components as a tuning capacitor, a temperature sensing thermistor and other small components associated with matching the transducer to the line through the transformer, as well as establishing connections between the various components. The configuration of the transformer and associated components may be in accordance with known practice, again for example as disclosed in U.S. Pat. No. 5,347,495 (Cherek et all, and forms no part of the present invention beyond the necessity to accommodate components thereof in the transducer. This stage completes electrical assembly of the transducer.

In a following stage, further mouldings 32, 34 of harder rubber are applied to the loading block 4, again using cyanoacrylate adhesive, the moulding 32 having an upwardly extending cylindrical skirt 35 such as to surround the entire assembly, except for the distal portion of cable 28. In the example shown, the mouldings 32 is of 25 durometer hardness flame retardant rubber, for example a blend of polychloroprene and E.P.D.M. The moulding 34 covers the bottom face of the block 4 to form an acoustic matching layer as described further in the Hands and Brown et al patents referenced above. The properties required in the matching layer formed by moulding 34 are different from those required in the layer formed by moulding 32, since it must both provide appropriate acoustic matching as well as being resistant to hostile environments and flame retardant. An example of a suitable material is a chlorosulphonated polyethylene sold under the trademark HYPOLON by DuPont, whose density is reduced by admixture of glass microspheres, and which has a durometer hardness of 85. If the transducer is to be utilized in a particularly aggressive atmosphere, it is possible to cast in a very thin diaphragm (not shown) of stainless steel or other resistant material beneath the layer 34 to protect the radiating face of the latter. The moulding 34 is adhesively secured using cyanoacrylate adhesive to the radiating face of block 4.

Next, a further damping layer in the form of a moulding 36, typically of similar material as the layer 20 but of 70 durometer hardness, is applied around the layer 32, to which it is adhered using cyanoacrylate adhesive.

The free space 37 within the skirt 35 and around the electronic components is then filled with a potting compound so as to secure these components into a solid block.

The compound is injected through a port 39, the space being vented through a port 41.

Finally the assembly with the mouldings applied is as in the previous embodiment, inserted into an external casing 38 in form of an outer generally cylindrical shell moulded from rigid synthetic resin such as polypropylene or polyvinylidene fluoride such that a strain relief portion 40 of the layer 36 around the cable 28 emerges through an opening of the top of the casing. The casing 38 may be moulded with a mounting thread 42. The casing 38 is formed with barbed ribs 43 to retain the moulding 36.

Particularly since the layers 32 and 34 are moulded separately, none of the mouldings applied to the transducer assembly completely envelopes the assembly produced by the preceding stage, thus facilitating. As well as being adhered to the block 4, the moulding 32 is also adhered to the mouldings 32 and 36 so as, together with the potting compound in cavity 37, to seal in the transducer completely.

It will be noted that as in the previous embodiment, successive superposed layers of moulded material between the cylindrical wall of the casing 38 have in general alternating degrees of hardness, thus contributing to isolating the active components of transducer acoustically from its outer casing.

We claim:

1. A method of manufacturing an electro-acoustic transducer comprising forming a transducer assembly comprising at least one piezo-electric element, electrical connections to the assembly, and acoustic loading blocks, one of which forms the front of the assembly, and applying successive superposed moldings of material of differing acoustic properties around said transducer assembly to form the transducer, while maintaining electrical coupling between the electrical connections to the transducer assembly and a location exterior of the transducer, the moldings providing at least one acoustic matching layer covering a radiating surface of the transducer assembly, a casing surrounding the remainder of the transducer assembly, and at least two layers of material including a layer of acoustic isolating material between the casing and the transducer assembly;

wherein successively applied preformed moldings are shaped such that they do not completely envelop the assembly thus allowing for easy application to the assembly of the moldings used to form those layers.

2. A method according to claim 1, wherein successively applied preformed mouldings are shaped such that they do not completely envelope the assembly thus allowing for easy application to the assembly of the mouldings used to form those layers.

3. A method according to claim 1, wherein certain of the preformed mouldings are configured to leave a cavity around electronic components of the transducer assembly, and the cavity is filled with a potting compound.

4. A method according to claim 1, wherein superposed layers of material applied around the transducer assembly within a cylindrical wall of the casing have alternating degrees of hardness.

5. A method according to claim 1, wherein superposed layers of material applied around the transducer assembly within a cylindrical wall of the casing have alternating degrees of hardness.

6. A method according to claim 1, wherein the layer forming the casing is separately moulded, and pressed onto the assembly after the application of the successive layers of material thereon.

* * * * *